US007950245B2

(12) United States Patent
Lee et al.

(10) Patent No.: US 7,950,245 B2
(45) Date of Patent: May 31, 2011

(54) REFRIGERATOR RELATED TECHNOLOGY

(75) Inventors: Youn Seok Lee, Seoul (KR); Jang Seok Lee, Seoul (KR); Min Kyu Oh, Seoul (KR); Kyeong Yun Kim, Seoul (KR); Su Nam Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/634,849

(22) Filed: Dec. 10, 2009

(65) Prior Publication Data

US 2010/0180621 A1 Jul. 22, 2010

(30) Foreign Application Priority Data

Jan. 21, 2009 (KR) ..... 10-2009-0005011

(51) Int. Cl.
*F25D 21/14* (2006.01)

(52) U.S. Cl. ..... 62/285; 62/291

(58) Field of Classification Search ..... 62/285, 62/291, 277, 407, 419, 440, 442, 448, 515; 312/116, 117
See application file for complete search history.

(56) References Cited

U.S. PATENT DOCUMENTS

| | | | | |
|---|---|---|---|---|
| 3,122,899 | A * | 3/1964 | Costantini et al. | 62/419 |
| 3,712,078 | A * | 1/1973 | Maynard et al. | 62/448 |
| 5,086,627 | A * | 2/1992 | Borgen | 62/229 |
| 5,284,023 | A * | 2/1994 | Silva et al. | 62/77 |
| 5,622,059 | A * | 4/1997 | McClellan | 62/448 |
| 6,467,859 | B2 * | 10/2002 | Branz et al. | 312/292 |
| 6,735,976 | B2 | 5/2004 | Lee | |
| 6,997,008 | B2 | 2/2006 | Lee et al. | |
| 7,003,973 | B2 | 2/2006 | Lee et al. | |
| 7,040,118 | B2 | 5/2006 | Jung | |
| 7,114,345 | B2 | 10/2006 | Kim et al. | |
| 7,185,509 | B2 | 3/2007 | Lee et al. | |
| 7,188,490 | B2 | 3/2007 | Jeong et al. | |
| 7,322,209 | B2 | 1/2008 | Hwang et al. | |
| 2002/0093276 | A1 * | 7/2002 | Kawakami | 312/405 |
| 2004/0040338 | A1 * | 3/2004 | Lee et al. | 62/441 |
| 2004/0139763 | A1 * | 7/2004 | Jeong et al. | 62/448 |
| 2004/0144130 | A1 * | 7/2004 | Jung | 62/513 |
| 2004/0163408 | A1 * | 8/2004 | Kim et al. | 62/428 |
| 2005/0218766 | A1 | 10/2005 | Hwang | |

FOREIGN PATENT DOCUMENTS

| | | |
|---|---|---|
| JP | 7-19704 | 1/1995 |

* cited by examiner

*Primary Examiner* — Mohammad Ali

(74) *Attorney, Agent, or Firm* — Fish & Richardson P.C.

(57) ABSTRACT

In a refrigerator, cold air discharged from a cold air fan is guided by a guide member such that it flows directly to an evaporator. The guide member reduces flow of air through a gap between an inner surface of a cold air generating compartment and the evaporator. The guide member also includes a drainage portion configured to guide defrost water generated at the cold air fan to a position beneath the evaporator.

19 Claims, 6 Drawing Sheets

REFRIGERATOR RELATED TECHNOLOGY

CROSS REFERENCE TO RELATED APPLICATION

This application claims the benefit of Korean Patent Application No. 10-2009-0005011, filed on Jan. 21, 2009, which is hereby incorporated by reference as if fully set forth herein.

FIELD

The present disclosure relates to refrigerator technology.

BACKGROUND

A refrigerator is used to supply cold air generated at an evaporator to a storage compartment (e.g., a refrigerating and/or freezing compartment) to maintain freshness of various food products stored in the storage compartment. Such a refrigerator includes a body, in which a storage compartment is defined to store food in a low-temperature state therein. A door is mounted to a front side of the body to open or close the storage compartment.

A cooling cycle is included in the refrigerator to cool the storage compartment through circulation of a refrigerant. A machine compartment also is defined in the body to accommodate a plurality of electric elements used to configure the cooling cycle.

For instance, the cooling cycle includes a compressor to perform a temperature/pressure increasing operation upon a low-temperature/low-pressure gaseous refrigerant such that the low-temperature/low-pressure gaseous refrigerant is changed into a high-temperature/high-pressure gaseous refrigerant. The cooling cycle also includes a condenser to condense the refrigerant supplied from the compressor, using ambient air, an expansion valve to perform a pressure reducing operation upon the refrigerant supplied from the condenser such that the refrigerant is expanded, and an evaporator to evaporate the refrigerant emerging from the expansion valve in a low pressure state, thereby absorbing heat from the interior of the refrigerator.

A blowing fan is installed in the machine compartment to cool the compressor and condenser. Through holes are defined at opposite sides of the machine compartment to allow introduction and discharge of ambient air, respectively.

In accordance with the above-mentioned structure, ambient air is introduced into the interior of the machine compartment through one of the through holes (e.g., an inlet hole) when the blowing fan rotates. The introduced air passes along the condenser and compressor, and is then outwardly discharged from the machine compartment through the other through hole (e.g., an outlet hole). During this procedure, the condenser and compressor are cooled by the ambient air.

A refrigerator may be a top mount type in which freezing and refrigerating compartments are vertically arranged, and freezing and refrigerating compartment doors are mounted to the freezing and refrigerating compartments to open or close the freezing and refrigerating compartments, respectively. A refrigerator also may be a bottom freezer type in which freezing and refrigerating compartments are vertically arranged, hinged refrigerating compartment doors are pivotally mounted to left and right sides of the refrigerating compartment, and a drawer type freezing compartment door is mounted to the freezing compartment such that the freezing compartment door slides in forward and rearward directions of the freezing compartment to open or close the freezing compartment. A refrigerator further may be a side-by-side type in which freezing and refrigerating compartments are horizontally arranged for an increased refrigerator size, and freezing and refrigerating compartment doors are pivotally mounted to the freezing and refrigerating compartments in a side-by-side fashion to open or close the freezing and refrigerating compartments, respectively.

SUMMARY

In one aspect, a refrigerator includes a body, a storage compartment defined in a first portion of the body, and a cold air generating compartment defined in an upper portion of the body. The upper portion of the body is positioned above the storage compartment when the refrigerator is oriented in an ordinary operating orientation. The refrigerator also includes an evaporator positioned in the cold air generating compartment and a cold air fan positioned in the cold air generating compartment and configured to promote movement of air within the cold air generating compartment in a flow direction that passes over the evaporator. The refrigerator further includes a guide member arranged between the cold air fan and the evaporator and configured to guide cold air flowing from the cold air fan toward the evaporator such that the cold air passes along the evaporator.

Implementations may include one or more of the following features. For example, the guide member may at least partially obstructs a gap between the evaporator and a lower surface of the cold air generating compartment. The guide member may close the gap between the evaporator and the lower surface of the cold air generating compartment.

In some examples, the refrigerator may include a cold air inlet positioned at the cold air generating compartment. The cold air flowing from the storage compartment may pass through the cold air inlet. In these examples, the refrigerator may include a cold air outlet positioned at the cold air generating compartment. The cold air flowing into the storage compartment may pass through the cold air outlet. Further, in these examples, the refrigerator may include an orifice arranged adjacent to the cold air inlet and configured to receive the cold air fan. The guide member may extend from the orifice toward the evaporator. The guide member may be inclined from the cold air fan toward the gap.

In some implementations, the refrigerator may include a holder coupled to a lower surface of the evaporator and configured to fix the evaporator in the cold air generating compartment in a state in which the evaporator is spaced apart from the lower surface of the cold air generating compartment by a height of the gap. In these implementations, the guide member may include a guide plate supported by the holder at one side of the guide plate and configured to guide air flowing toward the evaporator by the cold air fan. The guide member also may include a drainage portion provided at a middle portion of the guide plate such that the drainage portion extends in a flow direction of the cold air and includes a groove configured to guide discharge of defrost water generated at the cold air fan.

In some examples, the refrigerator may include a drain pan arranged beneath the evaporator and configured to collect defrost water. In these examples, an end of the guide member opposite to the cold air fan may be positioned at the drain pan. The guide plate may include a guide portion configured to guide cold air propelled by the cold air fan such that the cold air flows directly toward the evaporator and a support portion that is bent from an end of the guide portion connected to the support portion toward the drain pan. The support portion may have an inclination larger than an inclination of the guide portion. The support portion may be horizontally supported by the holder or the evaporator, may be in close contact with the holder or the evaporator, and may be vertically supported by the drain pan. The guide portion may be directed toward a lower end of the evaporator to reduce cold air from being introduced into the gap defined by the holder.

The refrigerator may include a cold air inlet positioned between the storage compartment and the cold air generating compartment and configured to guide cold air from the storage compartment into the cold air generating compartment. The refrigerator also may include a cold air outlet positioned between the storage compartment and the cold air generating compartment and configured to guide cold air from the cold air generating compartment toward the storage compartment.

In another aspect, a refrigerator includes a body, a storage compartment defined in a first portion of the body, and a cold air generating compartment defined in an upper portion of the body. The upper portion of the body is positioned above the storage compartment when the refrigerator is oriented in an ordinary operating orientation. The refrigerator also includes an evaporator positioned in the cold air generating compartment and a holder configured to support the evaporator in the cold air generating compartment in a manner that defines a gap between a surface of the cold air generating compartment and the evaporator. The refrigerator further includes a cold air fan positioned in the cold air generating compartment and configured to promote movement of air within the cold air generating compartment in a flow direction that passes over the evaporator and a drain pan arranged beneath the evaporator and configured to collect defrost water generated at the evaporator and defrost water generated at the cold air fan. In addition, the refrigerator includes a guide member that is inclined, that extends from the cold air fan to the drain pan, and that is configured to reduce flow of cold air into the gap defined between the surface of the cold air generating compartment and the evaporator.

Implementations may include one or more of the following features. For example, the guide member may include a guide plate supported by the holder at one side of the guide plate and configured to guide a flow direction of the cold air propelled by the cold air fan and a drainage portion that is provided at a middle portion of the guide plate such that the drainage portion extends in a flow direction of the cold air and that is configured to guide defrost water generated at the cold air fan.

In addition, the guide plate may include a guide portion extending toward a lower end of the evaporator and configured to guide cold air propelled by the cold air fan such that the cold air flows directly toward the evaporator. The guide plate also may include a support portion bent from an end of the guide portion connected to the support portion toward the drain pan such that the support portion is horizontally supported by the holder or the evaporator, is in close contact with the holder or the evaporator, and has an inclination angle with respect to a vertical axis smaller than an inclination angle of the guide portion with respect to the vertical axis.

The guide member may be configured to prevent flow of cold air into the gap defined between the surface of the cold air generating compartment and the evaporator. The guide member may at least partially obstruct the gap defined between the surface of the cold air generating compartment and the evaporator. The guide member may close the gap defined between the surface of the cold air generating compartment and the evaporator.

In some examples, the guide member may be inclined from the cold air fan toward the gap. In these examples, the guide member may include a recess configured to receive defrost water generated at the cold air fan and guide the received defrost to the drain pan.

DETAILED DESCRIPTION

Figure 1:
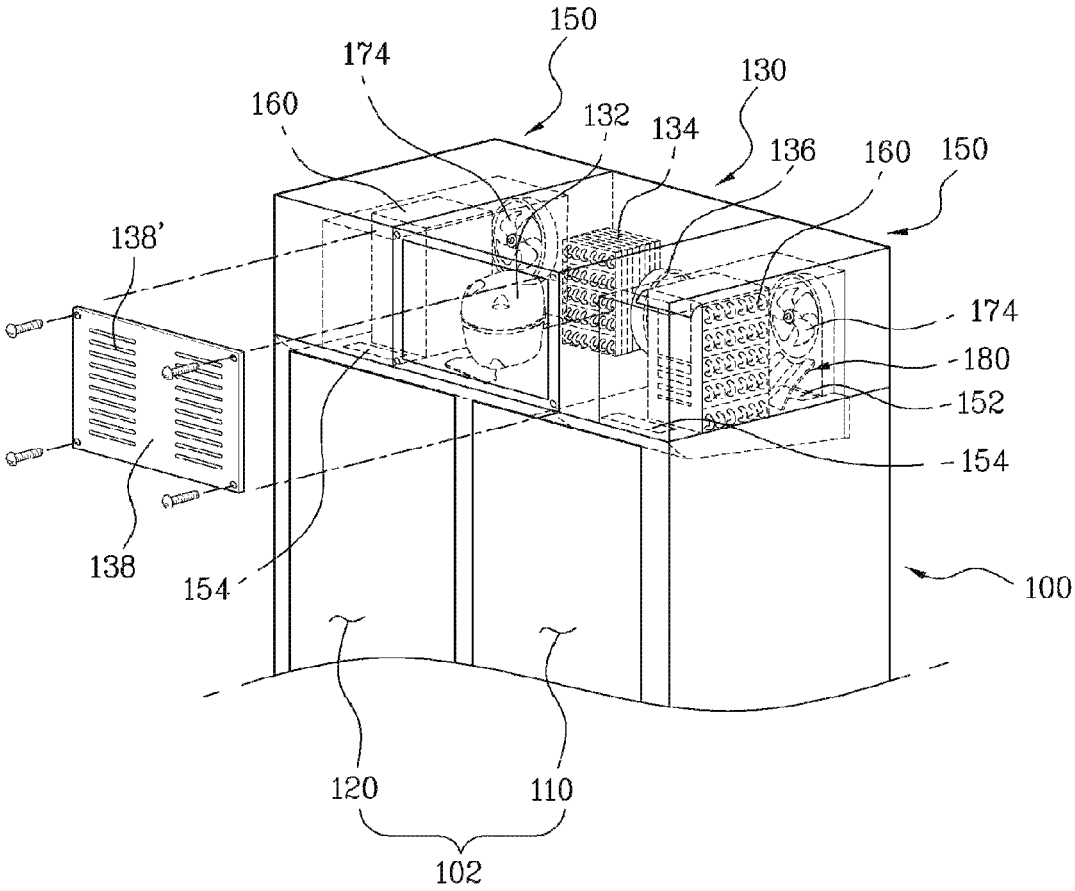
FIG. 1 is a perspective view illustrating an example configuration of a refrigerator.
Figure 2:
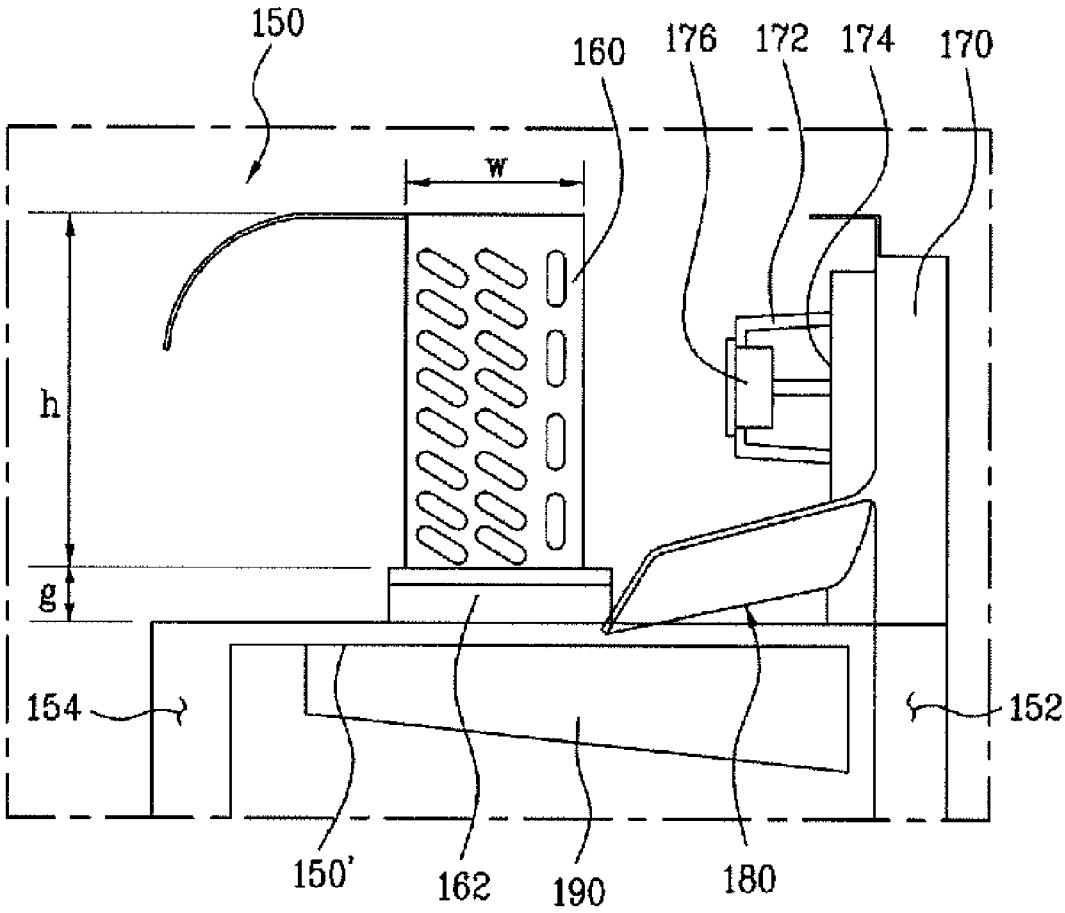
FIG. 2 is a side view illustrating an example cold air generating compartment.
Figure 3:
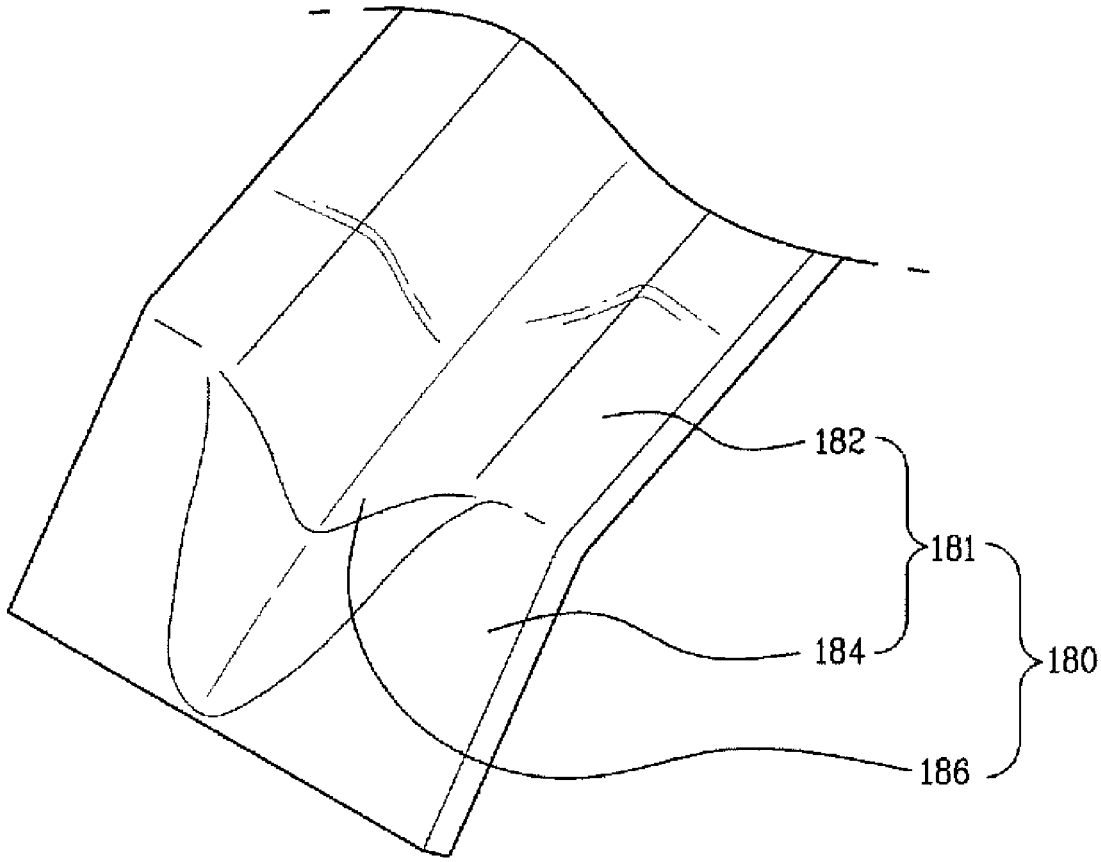
FIGS. 3 and 4 are a perspective view and a side view illustrating an example guide plate.
Figure 4:
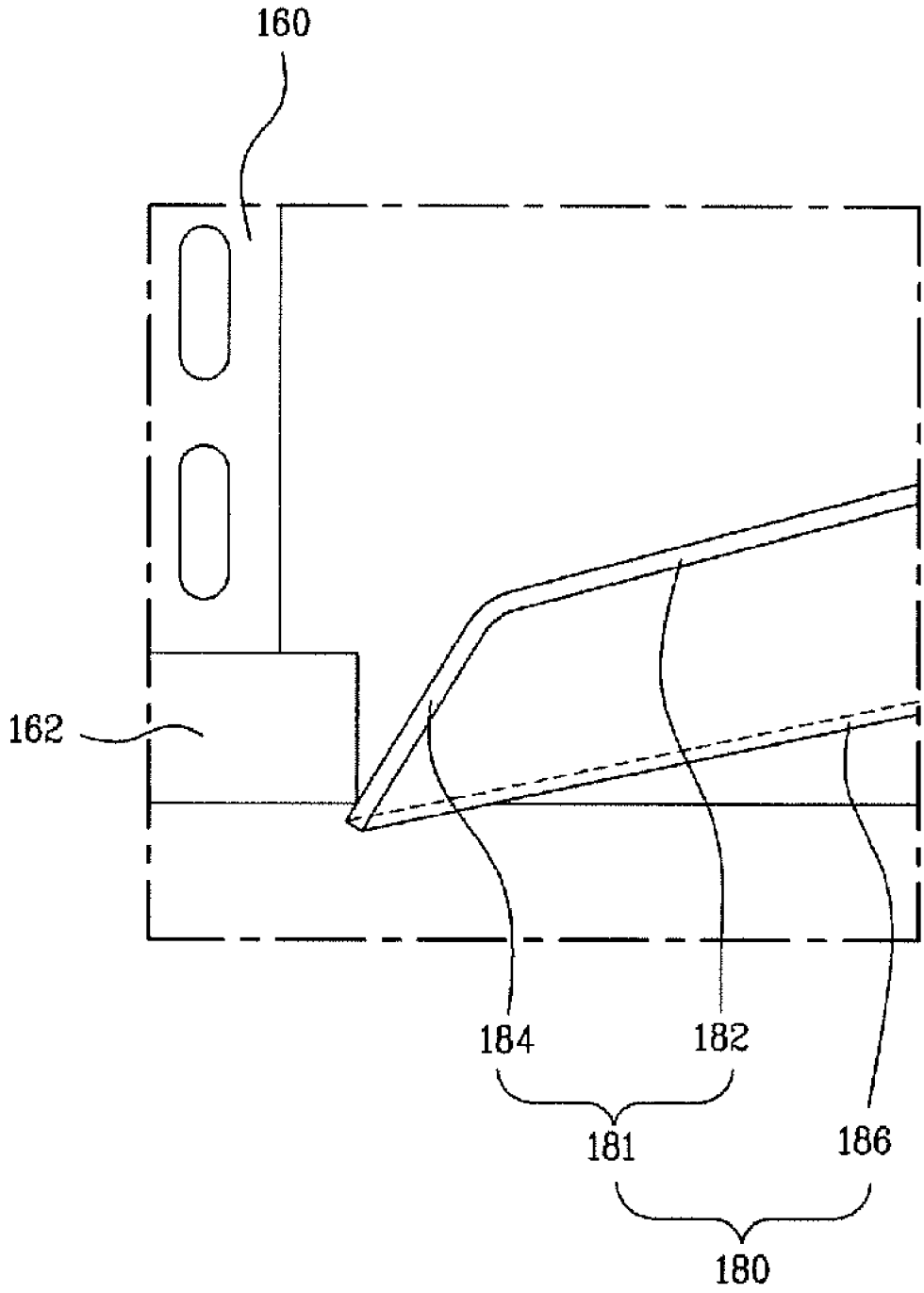

FIG. 1 illustrates an example configuration of a refrigerator. FIG. 2 illustrates an example cold air generating compartment. FIGS. 3 and 4 illustrate an example guide plate.

As shown in the drawings, in a body 100 that defines a frame of the refrigerator, a storage compartment 102 is defined. The storage compartment 102 is a space to store food in a low-temperature state, using cold air generated around an evaporator 160. A plurality of racks are vertically arranged in the storage compartment 102. A drawer type storage compartment may be defined beneath the racks.

The storage compartment 102 includes a refrigerating compartment 110 and a freezing compartment 120. The refrigerating compartment 110 and freezing compartment 120 are separated from each other by a partition wall so that they define separate storage spaces, respectively.

A machinery compartment 130 also is defined in the body 100. The machinery compartment 130 is arranged at an upper portion of the body 100. In other examples, the machinery compartment 130 may be arranged at a lower portion of the body 100 in accordance with design conditions. An accommodation space is defined in the machinery compartment 130. In the accommodation space, one or more elements constituting a refrigeration cycle are accommodated. For instance, a compressor 132, a condenser 134, an expansion valve, and a blowing fan 136 are arranged in the machinery compartment 130.

The compressor 132 functions to compress a low-temperature/low-pressure gaseous refrigerant circulating the refrigeration cycle into a high-temperature/high-pressure gaseous refrigerant. The refrigerant emerging from the compressor 132 is introduced into the condenser 134.

The condenser 134 phase-changes the refrigerant compressed by the compressor 132 into a normal-temperature/high-pressure liquid refrigerant, through heat exchange. The condenser 134 includes a tubular refrigerant pipe repeatedly bent multiple times. The refrigerant pipe of the condenser 134 is repeatedly bent multiple times to have continuous pipe portions spaced apart from one another by a uniform gap. In accordance with the repeated bending of the refrigerant pipe, the condenser 134 generally has a rectangular hexahedral shape. The blowing fan 136 is arranged in the vicinity of the condenser 134, to blow ambient air toward the condenser 134.

The refrigerant emerging from the condenser 134 passes through the expansion valve. The expansion valve has a reduced diameter, as compared to those of other parts, to reduce the pressure of the refrigerant emerging from the condenser 134, and thus to expand the refrigerant.

A cover member 138 is arranged at a front side of the machinery compartment 130 to screen the accommodation space. Through holes 138' are defined through the cover member 138 to allow ambient air to be introduced into the machinery compartment 130 or to allow air present in the machinery compartment 130 to be outwardly discharged.

A cold air generating compartment 150 also defined is in the body 100. The cold air generating compartment 150 is a space in which one or more components that generate cold air are installed in order to maintain the storage compartment 102 at low temperature. The cold air generating compartment 150 has a rectangular hexagonal shape extending from a front side of the body 100 to a rear side of the body 100 in a longitudinal direction. Cold air emerging from the storage compartment 102 is introduced into a rear side of the cold air generating compartment 150, and is then discharged out of a front side of the cold air generating compartment 150 after being cooled in the cold air generating compartment 150. In some examples, a structure, in which cold air is introduced into the front side of the cold air generating compartment 150, and is then discharged out of the rear side of the cold air generating compartment 150, may be used. As shown in FIG. 1, the cold air generating compartment 150 is arranged at the upper portion of the body 100, adjacent to the machinery compartment 130, while being separated from the storage compartment 102 by one or more walls.

A cold air inlet 152 and a cold air outlet 154 are provided at a bottom plate 150' of the cold air generating compartment 150. The cold air inlet 152 and cold air outlet 154 are arranged between the storage compartment 102 and the cold air generating compartment 150. The cold air inlet 152 is a port of the cold air generating compartment 150 through which cold air from the storage compartment 102 is introduced into the cold air generating compartment 150. The cold air outlet 154 is a port of the cold air generating compartment 150 through which cold air is discharged from the cold air generating compartment 150.

A guide duct is provided at the body 100. The guide duct defines a path to circulate the cold air generated by the evaporator 160 to the storage compartment 102. The guide duct communicates with the storage compartment 102 and cold air generating compartment 150. In the cold air generating compartment 150, a cold air fan 174 is provided together with the evaporator 160 such that they are horizontally arranged.

The evaporator 160 is configured to absorb heat from the surroundings when a liquid present in the evaporator 160 is changed into a gas and, thereby, decreases the temperature of the surroundings. Thus, the evaporator 160 absorbs heat from the surroundings as the refrigerant emerging from the expansion valve is evaporated in a low-pressure state.

As shown in FIG. 2, the evaporator 160 has a vertical length h perpendicular to a flow direction of cold air along the evaporator 160 and a horizontal length w parallel to the flow direction of cold air such that the vertical length h is longer than the horizontal length w. In the evaporator 160, the vertical length h perpendicular to the flow direction of cold air along the evaporator 160 may be longer than the horizontal length w parallel to the flow direction of cold air because the cold air generating compartment 150 extends in a horizontal direction, and cold air is introduced into and discharged out of the cold air generating compartment 150 at front and rear sides of the cold air generating compartment 150, respectively.

The evaporator 160 is mounted to a holder 162 fixed to the bottom plate 150' of the cold air generating compartment 150. The holder 162 supports the evaporator 160 such that the evaporator 160 is maintained in a fixed state in the cold air generating compartment 150. The holder 162 has a certain thickness, so that a certain gap g exists between a lower end of the evaporator 160 installed on the holder 162 and the bottom plate 150' of the cold air generating compartment 150. As a result, cold air may flow through the gap g between the evaporator 160 and the bottom plate 150' of the cold air generating compartment 150. The mounting structure of the evaporator 160 to the holder 162 that results in definition of the gap g reduces movement of the evaporator 160 due to circulation of cold air. For instance, the gap g, which is exists between the evaporator 160 and the bottom plate 150' of the cold air generating compartment 150, includes all gaps (or any type of gap) between the evaporator 160 and the inner surface of the cold air generating compartment 150.

An orifice 170 is provided in the cold air generating compartment 150. The orifice 170 is arranged adjacent to the evaporator 160 at a rear portion of the cold air generating compartment 150. The orifice 170 includes an orifice hole and a motor support 172.

The cold air fan 174 is connected to the orifice hole of the orifice 170. The cold air fan 174 discharges air as vanes thereof rotate to provide ventilation or heat removal. The cold air fan 174 generates a flow of cold air circulating the storage compartment 102, cold air generating compartment 150, etc.

A fan motor 176 is supported by the motor support 172. The fan motor 176 is arranged at the orifice 170 adjacent to the evaporator 160. The fan motor 176 provides a driving force to drive the cold air fan 174.

A guide member 180 is provided at the cold air generating compartment 150. The guide member 180 reduces cold air from being introduced into the gap g between the inner surface of the cold air generating compartment 150 and the evaporator 160. The guide member 180 is arranged between the cold air fan 174 and the evaporator 160, to close or at least partially obstruct the gap g.

The guide member 180, which is arranged between the evaporator 160 and the cold air fan 174, is inclined and extends from the side of the cold air fan 174 toward the gap g between the evaporator 160 and the cold air generating compartment 150.

The guide member 180 is arranged such that an end of the guide member 180 opposite to the cold air fan 174 is positioned over a drain pan 190. In accordance with this arrangement, defrost water flowing along the guide member 180 is guided to the drain pan 190.

The guide member 180 includes a guide plate 181 and a drainage portion 186. The guide plate 181 is supported, at one side thereof, by the holder 162, to guide a flow direction of cold air impelled by the cold air fan 174.

The guide plate 181 includes a guide portion 182 and a support portion 184. The guide portion 182 extends toward the lower end of the evaporator 160 in order to reduce cold air from being introduced into the gap g formed by the holder 162. The guide portion 182 guides cold air impelled by the cold air fan 174 such that the cold air flows directly toward the evaporator 160.

The support portion 184 is bent from an end of the guide portion 182 connected to the support portion 184 toward the drain pan 190. The support portion 184 is horizontally supported by the holder 162 or evaporator 160 in close contact with the holder 162 or evaporator 160, while being vertically supported by the drain pan 190. Thus, the support portion 184 fixes the guide member 180.

The support portion 184 may have an inclination larger than that of the guide portion 182 in order to enable an end of the support portion 184 opposite to the guide portion 182 to come into contact with a lower end of the holder 162 arranged beneath the evaporator 160 because the space between the orifice 170 receiving the cold air fan 174 and the holder 162 is relatively narrow.

The drainage portion 186 extends in a flow direction of cold air at a middle portion of the guide plate 181. The drainage portion 186 guides defrost water generated at the cold air fan 174 to flow downwardly to the drain pan 190. For instance, the drainage portion 186 extends in a longitudinal direction of the guide plate 181 at the middle portion of the guide plate 181. The drainage portion 186 has a shape that is upwardly concave.

A drain pan 190 is provided in the cold air generating compartment 150. The drain pan 190 is arranged beneath the evaporator 160 in the cold air generating compartment 150. The drain pan 190 collects defrost water generated at the evaporator 160 and defrost water generated at the cold air fan 174, and then outwardly discharges the collected defrost water.

Figure 5:
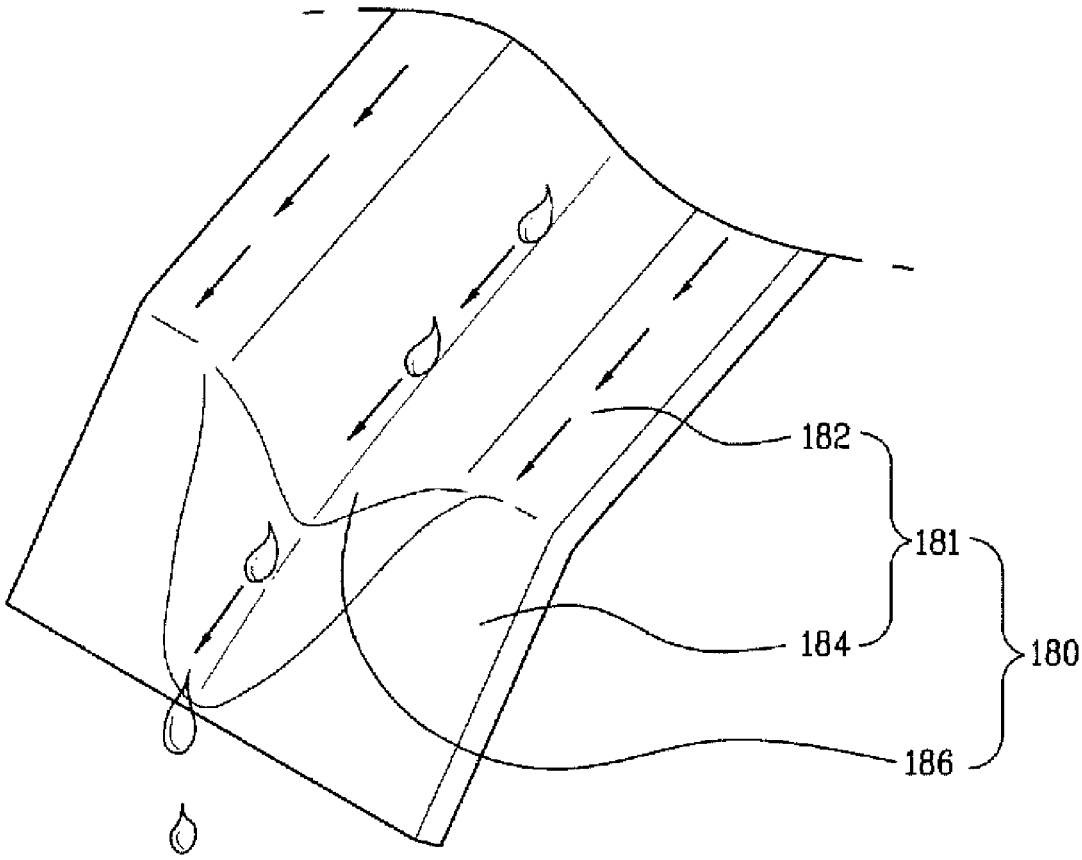
FIGS. 5 and 6 are schematic views illustrating example flows of cold air and defrost water.
Figure 6:
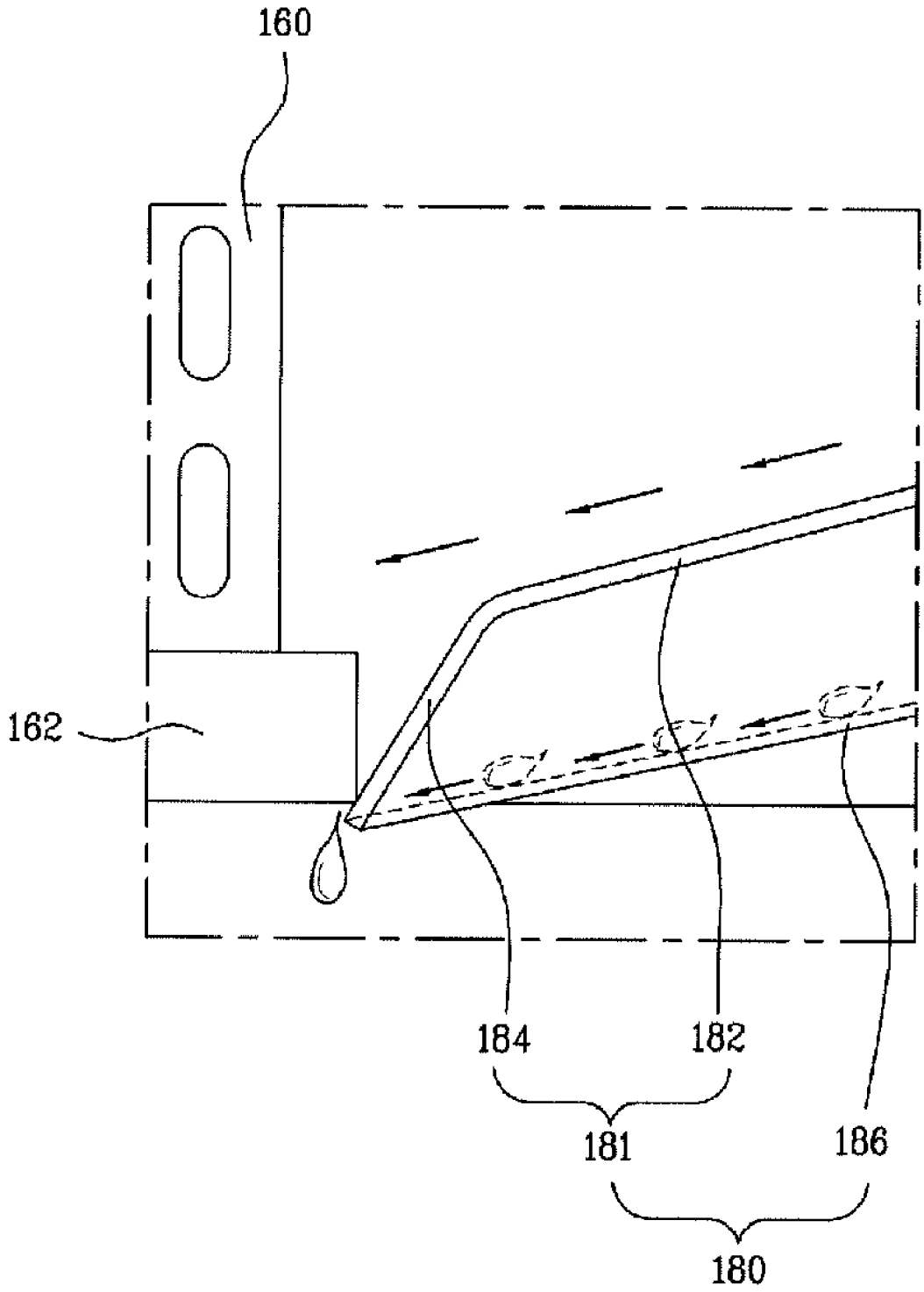

FIGS. 5 and 6 illustrate flows of cold air and defrost water. In the body 100, cold air present in the storage compartment 102 is introduced into the cold air generating compartment 150 after flowing through the cold air inlet 152. The cold air is cooled in the cold air generating compartment 150 in accordance with heat exchange thereof with the evaporator 160. The cold air is then again introduced into the storage compartment 102 after sequentially passing through the cold air outlet 154 and guide duct.

Thus, heat exchange is performed in the cold air generating compartment 150 arranged at the upper portion of the body 100. Because the cold air generating compartment 150 extends in forward and rearward directions of the body 100, and the evaporator 160 and cold air fan 174 are installed in the forward and rearward directions of the body 100, the installation of the evaporator 160 and cold air fan 174 can be achieved substantially irrespective of the height of the cold air generating compartment 150, as compared to the case in which the evaporator 160 and cold air fan 174 are vertically arranged.

Also, the evaporator 160 is configured such that the length h thereof perpendicular to the flow direction of cold air along the evaporator 160 is longer than the horizontal length w thereof parallel to the flow direction of cold air. In the evaporator 160 having the above-described structure, the length of a flow path, through which cold air flows along the evaporator 160, is reduced for a constant heat exchange area, as compared to a structure in which the length of the evaporator perpendicular to the flow direction of cold air is shorter than the horizontal length of the evaporator parallel to the flow direction of cold air. As a result, the flow resistance of cold air is reduced, as compared to the latter structure.

As shown in FIGS. 5 and 6, cold air discharged from the cold air fan 174 is guided along the guide portion 182 of the guide plate 181 such that it flows toward the evaporator 160. Because the guide portion 182 extends toward the lower end of the evaporator 160, the cold air is not guided to reach a position below the lower end of the evaporator 160. As a result, the cold air is may be reduced (e.g., prevented) from passing through the gap g between the evaporator 160 and the bottom plate 150' of the cold air generating compartment 150. As such, little or air flows through the gap g and misses the evaporator 160. Most cold air is cooled while passing along the evaporator 160.

Meanwhile, the defrost water generated at the cold air fan 174 flows downwardly along the drainage portion 186 of the guide member 180. Since the support portion 184 is supported by the holder 162 in close contact with the holder 162 and the drainage portion 186 is concave at the middle portion of the support portion 184, a certain space to allow flowing of defrost water therethrough exists between the holder 162 and the drainage portion 186. Accordingly, the defrost water flowing along the drainage portion 186 is introduced into the drain pan 190 through the space between the holder 162 and the drainage portion 186. Accordingly, little or no cold air is introduced into the space between the holder 162 and the drainage portion 186 because the space is relatively small. Also, because the end of the guide member 180 or drainage portion 186 opposite to the cold air fan 174 is positioned beneath the evaporator 160, the defrost water generated at the cold air fan 174 is collected at a position beneath the evaporator 160. Accordingly, it may be possible to reduce the size of the drain pan 190.

In some implementations, cold air discharged from the cold air fan is guided by the guide member such that it flows directly to the evaporator. Accordingly, little or no cold air passes through the gap between the inner surface of the cold air generating compartment and the evaporator. Thus, an enhancement in cooling efficiency may be achieved.

Also, in some examples, the guide member is provided with a drainage portion to guide defrost water generated at the cold air fan to a position beneath the evaporator. Accordingly, it is possible to remove both the defrost water generated at the evaporator and the defrost water generated at the cold air fan, using a single drain pan.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a body;

a storage compartment defined in a first portion of the body;

a cold air generating compaitment defined in an upper portion of the body, the upper portion of the body being positioned above the storage compartment when the refrigerator is oriented in an ordinary operating orientation;

an evaporator positioned in the cold air generating compartment;

a cold air fan positioned in the cold air generating compartment and configured to promote movement of air within the cold air generating compartment in a flow direction that passes over the evaporator, the cold air fan and the evaporator being arranged horizontally when the refrigerator is oriented in the ordinary operating orientation such that the flow direction of air passing over the evaporator is a horizontal direction; and a guide member arranged between the cold air fan and the evaporator and configured to guide cold air flowing from the cold air fan toward the evaporator such that the cold air passes along the evaporator, wherein the guide member at least partially obstructs a gap between the evaporator and a lower surface of the cold air generating compartment.

2. The refrigerator according to claim 1, further comprising:

a cold air inlet positioned at the cold air generating compartment, the cold air flowing from the storage compartment passing through the cold air inlet;

a cold air outlet positioned at the cold air generating compartment, the cold air flowing into the storage compartment passing through the cold air outlet; and an orifice arranged adjacent to the cold air inlet and configured to receive the cold air fan, wherein the guide member extends from the orifice toward the evaporator.

3. The refrigerator according to claim 2, wherein the guide member is inclined from the cold air fan toward the gap.

4. The refrigerator according to claim 3, further comprising:

a holder coupled to a lower surface of the evaporator and configured to fix the evaporator in the cold air generating compartment in a state in which the evaporator is spaced apart from the lower surface of the cold air generating compartment by a height of the gap, wherein the guide member comprises:

a guide plate supported by the holder at one side of the guide plate and configured to guide air flowing toward the evaporator by the cold air fan; and a drainage portion provided at a middle portion of the guide plate such that the drainage portion extends in a flow direction of the cold air and has a groove shape configured to guide discharge of defrost water generated at the cold air fan.

5. The refrigerator according to claim 4, further comprising:

a drain pan arranged beneath the evaporator and configured to collect defrost water, wherein an end of the guide member opposite to the cold air fan is positioned at the drain pan.

6. The refrigerator according to claim 5, wherein the guide plate comprises:

a guide portion configured to guide cold air propelled by the cold air fan such that the cold air flows directly toward the evaporator; and a support portion that is bent from an end of the guide portion connected to the support portion toward the drain pan.

7. The refrigerator according to claim 6, wherein the support portion has an inclination larger than an inclination of the guide portion.

8. The refrigerator according to claim 6, wherein the support portion is horizontally supported by the holder or the evaporator, is in close contact with the holder or the evaporator, and is vertically supported by the drain pan.

9. The refrigerator according to claim 6, wherein the guide portion is directed toward a lower end of the evaporator to reduce cold air from being introduced into the gap defined by the holder.

10. The refrigerator according to claim 1, further comprising:

a cold air inlet positioned between the storage compartment and the cold air generating compartment and configured to guide cold air from the storage compartment into the cold air generating compartment; and a cold air outlet positioned between the storage compartment and the cold air generating compartment and configured to guide cold air from the cold air generating compartment toward the storage compartment.

11. A refrigerator comprising:

a body;

a storage compartment defined in a first portion of the body;

a cold air generating compartment defined in an upper portion of the body, the upper portion of the body being positioned above the storage compartment when the refrigerator is oriented in an ordinary operating orientation;

an evaporator positioned in the cold air generating compartment;

a holder configured to support the evaporator in the cold air generating compartment in a manner that defines a gap between a surface of the cold air generating compartment and the evaporator;

a cold air fan positioned in the cold air generating compartment and configured to promote movement of air within the cold air generating compartment in a flow direction that passes over the evaporator, the cold air fan and the evaporator being arranged horizontally when the refrigerator is oriented in the ordinary operating orientation such that the flow direction of air passing over the evaporator is a horizontal direction;

a drain pan arranged beneath the evaporator and configured to collect defrost water generated at the evaporator and defrost water generated at the cold air fan; and a guide member that is inclined, that extends from the cold air fan to the drain pan, and that is configured to reduce flow of cold air into the gap defined between the surface of the cold air generating compartment and the evaporator.

12. The refrigerator according to claim 11, wherein the guide member comprises:

a guide plate supported by the holder at one side of the guide plate and configured to guide a flow direction of the cold air propelled by the cold air fan; and a drainage portion that is provided at a middle portion of the guide plate such that the drainage portion extends in a flow direction of the cold air and that is configured to guide defrost water generated at the cold air fan.

13. The refrigerator according to claim 12, wherein the guide plate comprises:

a guide portion extending toward a lower end of the evaporator and configured to guide cold air propelled by the cold air fan such that the cold air flows directly toward the evaporator; and a support portion bent from an end of the guide portion connected to the support portion toward the drain pan such that the support portion is horizontally supported by the holder or the evaporator, is in close contact with the holder or the evaporator, and has an inclination angle with respect to a vertical axis smaller than an inclination angle of the guide portion with respect to the vertical axis.

14. The refrigerator according to claim 11, wherein the guide member is configured to prevent flow of cold air into the gap defined between the surface of the cold air generating compartment and the evaporator.

15. The refrigerator according to claim 11, wherein the guide member at least partially obstructs the gap defined between the surface of the cold air generating compartment and the evaporator.

16. The refrigerator according to claim 15, wherein the guide member closes the gap defined between the surface of the cold air generating compartment and the evaporator.

17. The refrigerator according to claim 11, wherein the guide member is inclined from the cold air fan toward the gap.

18. The refrigerator according to claim 17, wherein the guide member has a groove shape configured to receive defrost water generated at the cold air fan and guide the received defrost to the drain pan.

19. A refrigerator comprising:

a body;

a storage compartment defined in a first portion of the body;

a machinery compartment which accommodates one or more elements of a refrigeration cycle, the machinery compartment defined in an upper portion of the body and separated from the storage compartment, the upper portion of the body being positioned above the storage compartment when the refrigerator is oriented in an ordinary operating orientation;

a pair of cold air generating compartments arranged in an upper portion of the body adjacent to the machinery compartment and separated from the storage compartment;

a pair of evaporators positioned in the cold air generating compartments respectively;

a pair of cold air fans positioned in the cold air generating compartments respectively and configured to promote movement of air in a flow direction that passes over the evaporator, the cold air fans and the evaporator being arranged horizontally when the refrigerator is oriented in the ordinary operating orientation such that the flow direction of air passing over the evaporator is a horizontal direction; and a pair of guide members arranged between the cold air fans and the evaporator respectively and configured to guide cold air flowing from the cold air fans toward the evaporator such that the cold air passes along the evaporator.

* * * * *